US011302197B2

(12) United States Patent
Fang et al.

(10) Patent No.: US 11,302,197 B2
(45) Date of Patent: Apr. 12, 2022

(54) VEHICLE BEHAVIOR PREDICTION METHOD AND VEHICLE BEHAVIOR PREDICTION DEVICE

(71) Applicants: Nissan Motor Co., Ltd., Yokohama (JP); Renault S.A.S., Boulogne-Billancourt (FR)

(72) Inventors: Fang Fang, Kanagawa (JP); Takuya Nanri, Kanagawa (JP); Shoutaro Yamaguchi, Kanagawa (JP)

(73) Assignees: Nissan Motor Co., Ltd., Yokohama (JP); Renault S.A.S., Boulogne-Billancourt (FR)

( * ) Notice: Subject to any disclaimer, the term of this patent is extended or adjusted under 35 U.S.C. 154(b) by 0 days.

(21) Appl. No.: 17/276,221

(22) PCT Filed: Sep. 17, 2018

(86) PCT No.: PCT/IB2018/001582
§ 371 (c)(1),
(2) Date: Mar. 15, 2021

(87) PCT Pub. No.: WO2020/058740
PCT Pub. Date: Mar. 26, 2020

(65) Prior Publication Data

US 2022/0028274 A1 Jan. 27, 2022

(51) Int. Cl.
*G08G 1/16* (2006.01)

(52) U.S. Cl.
CPC ..... *G08G 1/167* (2013.01); *G08G 1/166* (2013.01)

(58) Field of Classification Search
None
See application file for complete search history.

(56) References Cited

U.S. PATENT DOCUMENTS

| | | | | |
|---|---|---|---|---|
| 10,142,595 | B2 * | 11/2018 | Tsuchiya | G08G 1/167 |
| 11,002,859 | B1 * | 5/2021 | Zhang | G01S 17/06 |
| 11,150,342 | B2 * | 10/2021 | Duque Biarge | G06T 7/11 |
| 2014/0118551 | A1 * | 5/2014 | Ikeda | G06K 9/00805 348/148 |
| 2014/0368330 | A1 * | 12/2014 | Watanabe | G08G 1/16 340/475 |

(Continued)

FOREIGN PATENT DOCUMENTS

JP 2011090582 A 5/2011

*Primary Examiner* — Muhammad Adnan
(74) *Attorney, Agent, or Firm* — Young Basile Hanlon & MacFarlane, P.C.

(57) ABSTRACT

A vehicle behavior prediction device includes an objection detection device for detecting a position of an object, with respect to a host vehicle, located on the front side or the lateral side of the host vehicle, and a moving object traveling further than the object from the host vehicle, and an behavior prediction unit. The behavior prediction unit calculates, based on the position detected by the objection detection device, a blind spot region from the host vehicle caused by the object in which the objection detection device cannot detect. The behavior prediction unit presumes a detection-available period from a point when the moving object is detected to a point when the moving object enters the blind spot region in a case in which the moving object travels in a predetermined course after being detected by the objection detection device.

17 Claims, 16 Drawing Sheets

(56) References Cited

U.S. PATENT DOCUMENTS

| | | | | |
|---|---|---|---|---|
| 2015/0232028 | A1* | 8/2015 | Reardon | B60R 1/12 348/148 |
| 2017/0174262 | A1* | 6/2017 | Kobayashi | G01S 19/14 |
| 2017/0291545 | A1* | 10/2017 | Lai | G08G 1/166 |
| 2018/0068191 | A1* | 3/2018 | Biemer | B60R 11/04 |
| 2018/0090006 | A1* | 3/2018 | Ikenouchi | G01S 17/86 |
| 2018/0118106 | A1* | 5/2018 | You | G06K 9/00791 |
| 2018/0233049 | A1* | 8/2018 | Ishii | G08G 1/162 |
| 2019/0333373 | A1* | 10/2019 | Fang | G08G 1/052 |
| 2019/0389464 | A1* | 12/2019 | Nanri | G08G 1/167 |
| 2020/0118442 | A1* | 4/2020 | Iihoshi | B60W 30/18163 |
| 2020/0269874 | A1* | 8/2020 | Zhan | G08G 1/167 |

* cited by examiner

VEHICLE BEHAVIOR PREDICTION METHOD AND VEHICLE BEHAVIOR PREDICTION DEVICE

TECHNICAL FIELD

The present invention relates to a vehicle behavior prediction method and a vehicle behavior prediction device.

BACKGROUND

Methods are known that inform a driver in a host vehicle of assistance information with regard to an oncoming vehicle traveling ahead of the host vehicle when the host vehicle is turning right at an intersection (Japanese Unexamined Patent Application Publication No. 2011-90582). The invention disclosed in Japanese Unexamined Patent Application Publication No. 2011-90582 defines the ranks of blind spots depending on what degree a following vehicle traveling behind an oncoming vehicle (a preceding vehicle) traveling straight on the oncoming road is entering a blind spot, according to a relationship between the type of the preceding vehicle and the type of the following vehicle. The invention disclosed in Japanese Unexamined Patent Application Publication No. 2011-90582 informs the driver of the assistance information in accordance with the rank of the blind spot defined.

SUMMARY

The invention disclosed in Japanese Unexamined Patent Application Publication No. 2011-90582, while defining the ranks of the blind spots depending on what degree the following vehicle is entering the blind spot caused by the preceding vehicle, fails to teach a prediction of a course that the following vehicle could take. The problem of the invention disclosed in Japanese Unexamined Patent Application Publication No. 2011-90582, which fails to teach the prediction of the course that the following vehicle could take, thus needs to be solved since the prediction of the course of the following vehicle can contribute to smooth traveling of the host vehicle. In addition, the prediction of the course of the following vehicle, which contributes to smooth traveling of the host vehicle, should be made at an early stage.

In view of the foregoing problem, the present invention provides a vehicle behavior prediction method and a vehicle behavior prediction device capable of predicting a course of a moving object traveling on the front side or the lateral side of a host vehicle at an early stage.

A vehicle behavior prediction method according to an aspect of the present invention detects a position of an object, with respect to a host vehicle, located on a front side or a lateral side of the host vehicle, and detects a moving object traveling further than the object from the host vehicle. The vehicle behavior prediction method presumes a detection-available period from a point when the moving object is detected to a point when the moving object enters a blind spot region in a case in which the moving object travels in a predetermined course after being detected. The vehicle behavior prediction method compares the presumed detection-available period with an actual detection-available period from the point when the moving object is detected to a point when the moving object actually enters the blind spot region, and predicts a course of the moving object in accordance with the result of the comparison.

The present invention can predict the course of the moving object traveling on the front side or the lateral side of the host vehicle at an early stage.

DETAILED DESCRIPTION

Figure 1:
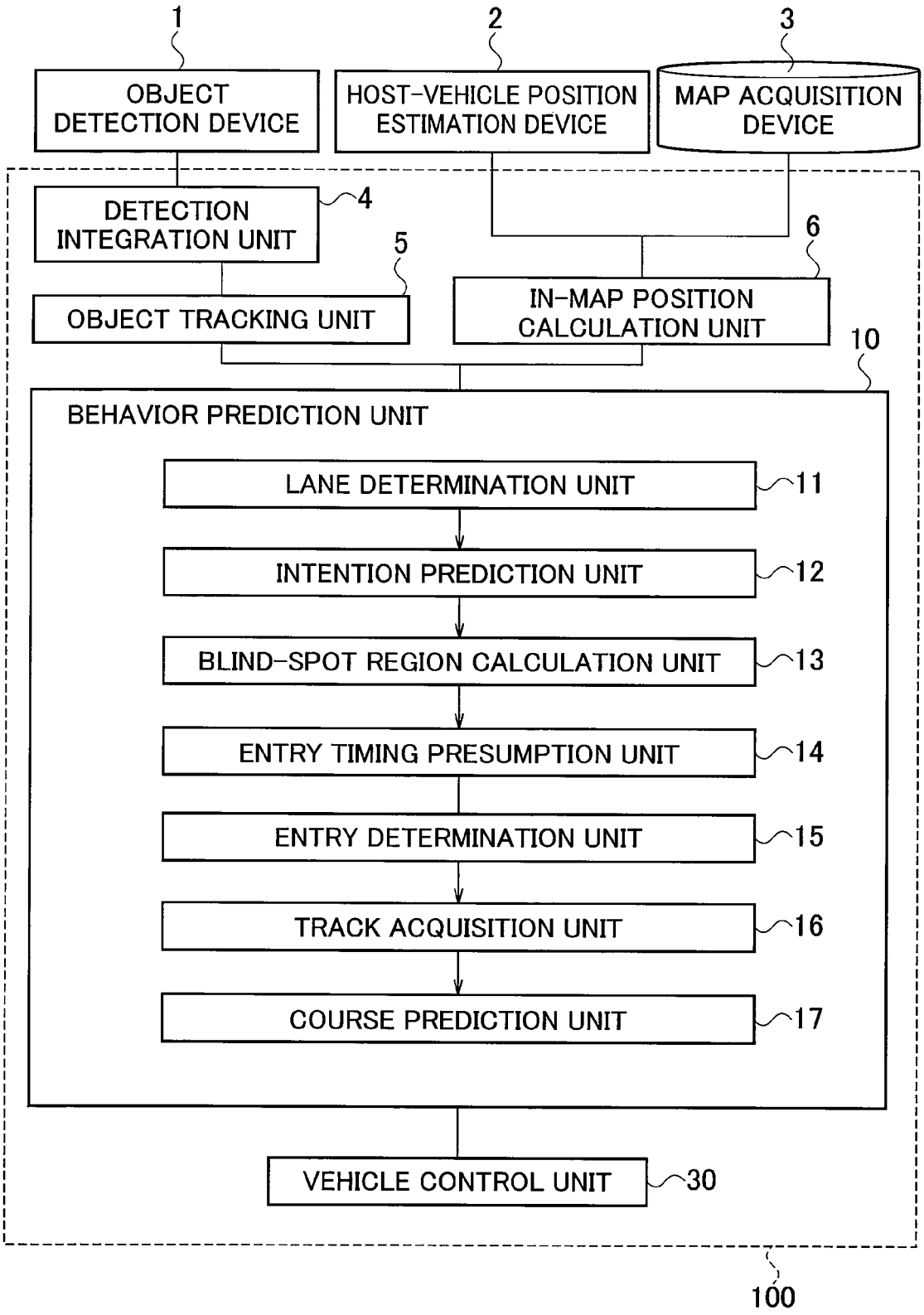
FIG. 1 is a schematic configuration diagram illustrating a vehicle behavior prediction device according to an embodiment of the present invention.

An embodiment of the present invention will be described below with reference to the drawings. The same elements illustrated in the descriptions of the drawings are indicated by the same reference numerals, and overlapping explanations are not made below.

(Configuration of Vehicle Behavior Prediction Device)

A configuration of a vehicle behavior prediction device is described below with reference to FIG. 1. The vehicle behavior prediction device includes an object detection device 1, a host-vehicle position estimation device 2, a map acquisition device 3, and a controller 100. The vehicle behavior prediction device may be used in either a vehicle having an autonomous driving function or a vehicle not equipped with the autonomous driving function. The vehicle behavior prediction device may also be used in a vehicle which can switch between autonomous driving and manual driving. The term "autonomous driving" according to the present embodiment refers to a state in which at least any of the brake, accelerator, and steering actuators is controlled without the operation of the occupant involved. Namely, any other actuators can be operated by the occupant. The autonomous driving is only required to be in a state in which any control such as acceleration/deceleration control and lateral-position control is executed. The term "manual driving" according to the present embodiment refers to a state in which the occupant operates the brake, the accelerator, and the steering, for example.

The object detection device 1 includes object detection sensors, such as a laser radar, a millimeter-wave radar, and a camera, mounted on the host vehicle. The object detection device 1 detects objects around the host vehicle using the plural object detection sensors. The object detection device 1 also detects objects on the front side or the lateral side of the host vehicle. The object detection device 1 detects moving objects such as other vehicles, motorcycles, bicycles, and pedestrians, and stationary objects such as parked vehicles and constructions. For example, the object detection device 1 detects a position, an attitude (a yaw angle), a size, a velocity, acceleration, jerk, deceleration, and a yaw rate of a moving object or a stationary object with respect to the host vehicle.

The host-vehicle position estimation device 2 includes a position detection sensor, such as a global positioning system (GPS) and a means of odometry, mounted on the host vehicle to measure an absolute position of the host vehicle. The host-vehicle position estimation device 2 measures the absolute position of the host vehicle, which is the position, the attitude, and the velocity of the host vehicle based on a predetermined reference point, by use of the position detection sensor.

The map acquisition device 3 acquires map information indicating a structure of a road on which the host vehicle is traveling. The map information acquired by the map acquisition device 3 includes pieces of information on the road structure, such as absolute positions of lanes, and a connectional relation and a relative positional relation of lanes. The map information acquired by the map acquisition device 3 further includes pieces of information on facilities such as a parking lot and a gasoline station. The map acquisition device 3 may hold a map database storing the map information, or may acquire the map information from an external map data server through cloud computing. The map acquisition device 3 may acquire the map information through vehicle-to-vehicle communications or road-to-vehicle communications.

The controller 100 predicts a course of another vehicle in accordance with the detection results obtained by the object detection device 1 and the host-vehicle position estimation device 2 and the information acquired by the map acquisition device 3. The controller 100 is a general-purpose microcomputer including a central processing unit (CPU), a memory, and an input-output unit. A computer program is installed on the microcomputer so as to function as the vehicle behavior prediction device. The microcomputer functions as a plurality of information processing circuits included in the vehicle behavior prediction device when the computer program is executed. While the present embodiment is illustrated with the case in which the software is installed to fabricate the information processing circuits included in the vehicle behavior prediction device, dedicated hardware for executing each information processing as described below can be prepared to compose the information processing circuits. The respective information processing circuits may be composed of individual hardware.

The controller 100 includes, as the plural information processing circuits, a detection integration unit 4, an object tracking unit 5, an in-map position calculation unit 6, a behavior prediction unit 10, and a vehicle control unit 30. The behavior prediction unit 10 includes a lane determination unit 11, an intention prediction unit 12, a blind spot region calculation unit 13, an entry timing presumption unit 14, an entry determination unit 15, a track acquisition unit 16, and a course prediction unit 17.

The detection integration unit 4 integrates several detection results obtained by the respective object detection sensors included in the object detection device 1, and outputs a single detection result per object. In particular, the detection integration unit 4 calculates the behavior of an object, which is the most reasonable and has the least error among pieces of the behavior of the object detected by the respective object detection sensors, in view of error characteristics of the respective object detection sensors. The detection integration unit 4 collectively evaluates the detection results obtained by the various sensors by a conventional sensor fusion method, so as to obtain a more accurate detection result for each object.

The object tracking unit 5 tracks each object detected by the detection integration unit 4. In particular, the object tracking unit 5 makes a determination on the sameness (mapping) of the object detected at intervals in accordance with the behavior of the object output at different times, and tracks the object in accordance with the mapping result.

The in-map position calculation unit 6 estimates the position of the host vehicle on the map according to the absolute position of the host vehicle acquired by the host-vehicle position estimation device 2 and the map data acquired by the map acquisition device 3.

The lane determination unit 11 specifies the respective traveling lanes on the map in which the host vehicle and the object are traveling, in accordance with the object information acquired from the object tracking unit 5, and the own position estimated by the in-map position calculation unit 6.

The intention prediction unit 12 predicts all possible lanes in which the object can travel forward, in accordance with the information on the traveling lane acquired from the lane determination unit 11 and the road structure. For example, when the object is traveling in a lane on a single-lane road, there is one possible lane in which the object can travel forward. When the object is traveling in a lane on a two-lane road, there are two possible lanes in which the object can travel forward, including the same traveling lane in which the object keeps traveling straight and a lane adjacent to the traveling lane. The intention prediction unit 12 may predict a behavior of the object in accordance with the position, the direction, and the attitude of the object.

The blind spot region calculation unit 13 calculates a blind spot region from the host vehicle caused by an object around the host vehicle. The blind spot region refers to a region in which the object detection device 1 cannot detect another object because of the blind spot caused by the object.

The entry timing presumption unit 14 presumes a detection-available period from a point when a moving object is detected to a point when the moving object enters a blind spot region, when the moving object keeps traveling straight after being detected. The explanations are made in detail below.

The entry determination unit 15 determines whether the moving object enters the blind spot region before the detection-available period presumed by the entry timing presumption unit 14 has passed. In particular, the entry determination unit 15 compares the detection-available period presumed by the entry timing presumption unit 14 with an actual detection-available period so as to determine whether the actual detection-available period is shorter than the presumed detection-available period.

The track acquisition unit 16 acquires a track of the moving object during the period from the point when the moving object is detected to the point immediately before the moving object enters the blind spot region.

The course prediction unit 17 predicts a course of the moving object in accordance with the result determined by the entry determination unit 15. The course prediction unit 17 may predict the course of the moving object in accordance with the result determined by the entry determination unit 15 and the information acquired from the track acquisition unit 16.

The vehicle control unit 30 controls various kinds of actuators (such as the steering actuator, the acceleration pedal actuator, and the brake actuator) using the information acquired by the respective sensors to execute the autonomous driving control or driving assistance control (for example, autonomous braking) so as to cause the host vehicle to travel along a course preliminarily set.

An example of the course prediction method is described below with reference to FIG. 2 to FIG. 5.

Figure 2:
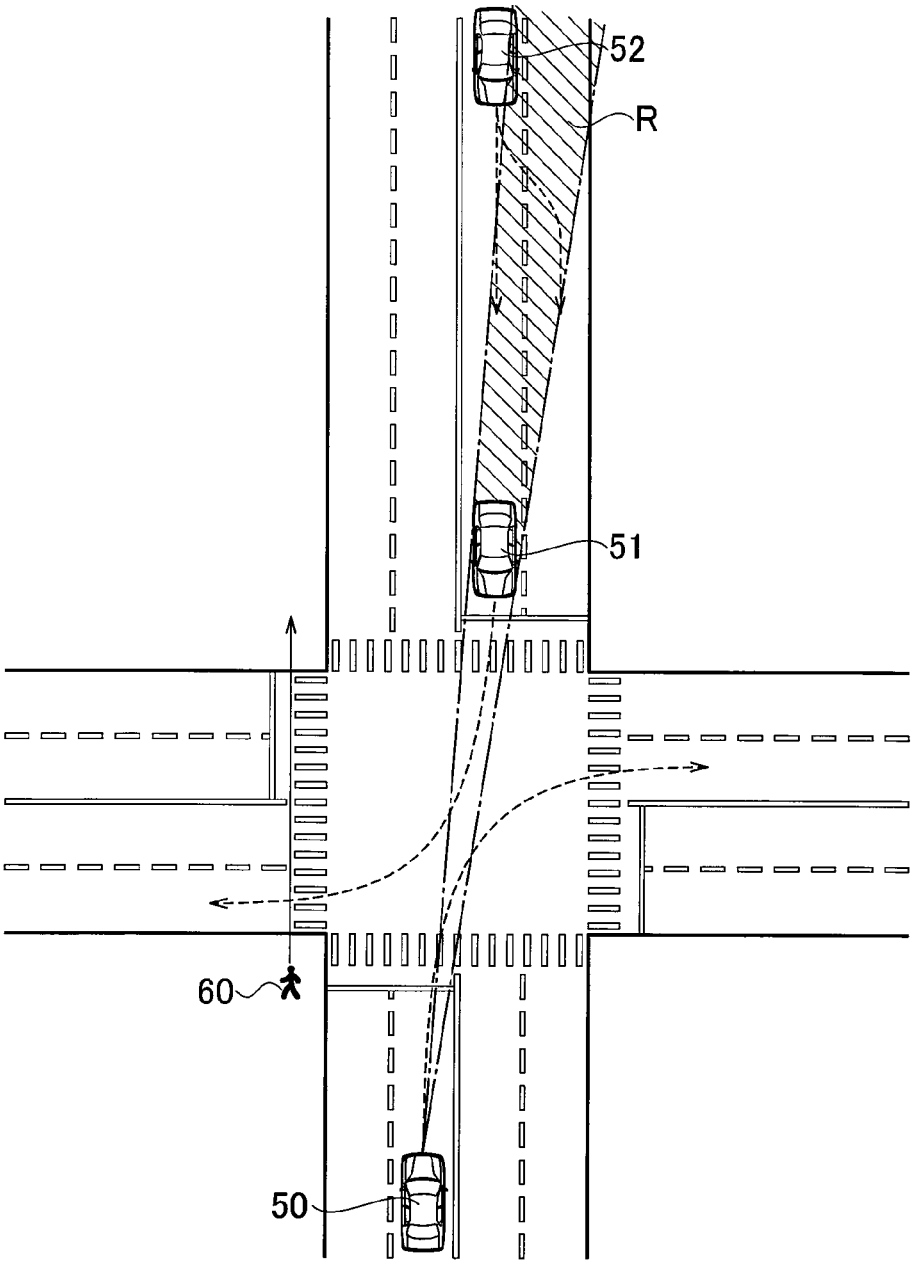
FIG. 2 is a diagram for explaining one example (an intersection) of a course prediction method for a moving object.

As illustrated in FIG. 2, the host vehicle 50 is traveling in the right lane on a two-lane road, and is to turn right at the next intersection. Another vehicle 51 is traveling in the right lane on the two-lane road, and is to turn right at the next intersection. The intention prediction unit 12 may predict whether the other vehicle 51 turns right at the next intersection in accordance with the position, the direction, the attitude, and the on/off state of the turn signals of the other vehicle 51. The other vehicle 51 is an oncoming vehicle traveling on the same road as the host vehicle 50 in the direction opposite to the direction in which the host vehicle 50 is traveling. Still another vehicle 52 is traveling behind the other vehicle 51. Reference sign R shown in FIG. 2 indicates a blind spot region from the host vehicle 50 caused by the other vehicle 51. The blind spot region R is calculated by the blind spot region calculation unit 13. In particular, the blind spot region calculation unit 13 calculates the blind spot region based on the position of the other vehicle 51 detected by the object detection device 1. The other vehicles 51 and 52 are present ahead of the host vehicle 50, and are detected by the object detection device 1. In the traveling situation illustrated in FIG. 2, the object detection device 1 can detect the other vehicle 52 which has not entered the blind spot region R yet. There are two possible courses on the road predicted for the other vehicle 52 to travel, as indicated by the arrows extending from the other vehicle 52. One of the courses is that the other vehicle 52 keeps traveling straight to follow the other vehicle 51. The other course is that the other vehicle 52 changes the lanes. According to the present embodiment, the case in which the other vehicle 52 enters the blind spot region R leads to the state in which the object detection device 1 cannot detect the other vehicle 52.

When the other vehicle 52 changes the lanes, the course of the other vehicle 52 and the course of the host vehicle 50 can intersect with each other. In this case, the other vehicle 52 has priority over the host vehicle 50, and the host vehicle 50 then needs to decelerate or stop. When the other vehicle 52 keeps traveling straight to follow the other vehicle 51, the course of the other vehicle 52 does not intersect with the course of the host vehicle 50, since the other vehicle 52 is also turning right at the intersection. In such a case, the host vehicle 50 can pass through the intersection without deceleration or stop. The situation illustrated in FIG. 2 thus requires the host vehicle 50 to predict the course of the other vehicle 52 at an early stage.

According to the present embodiment, the entry timing presumption unit 14 presumes the detection-available period from the point when the other vehicle 52 is detected to the point when the other vehicle 52 enters the blind spot region R, in the case in which the other vehicle 52 keeps traveling straight after being detected. The detection-available period is presumed on the assumption that the other vehicle 52 keeps traveling straight after being detected, in other words, the other vehicle 52 does not change its behavior after being detected.

Figure 3:
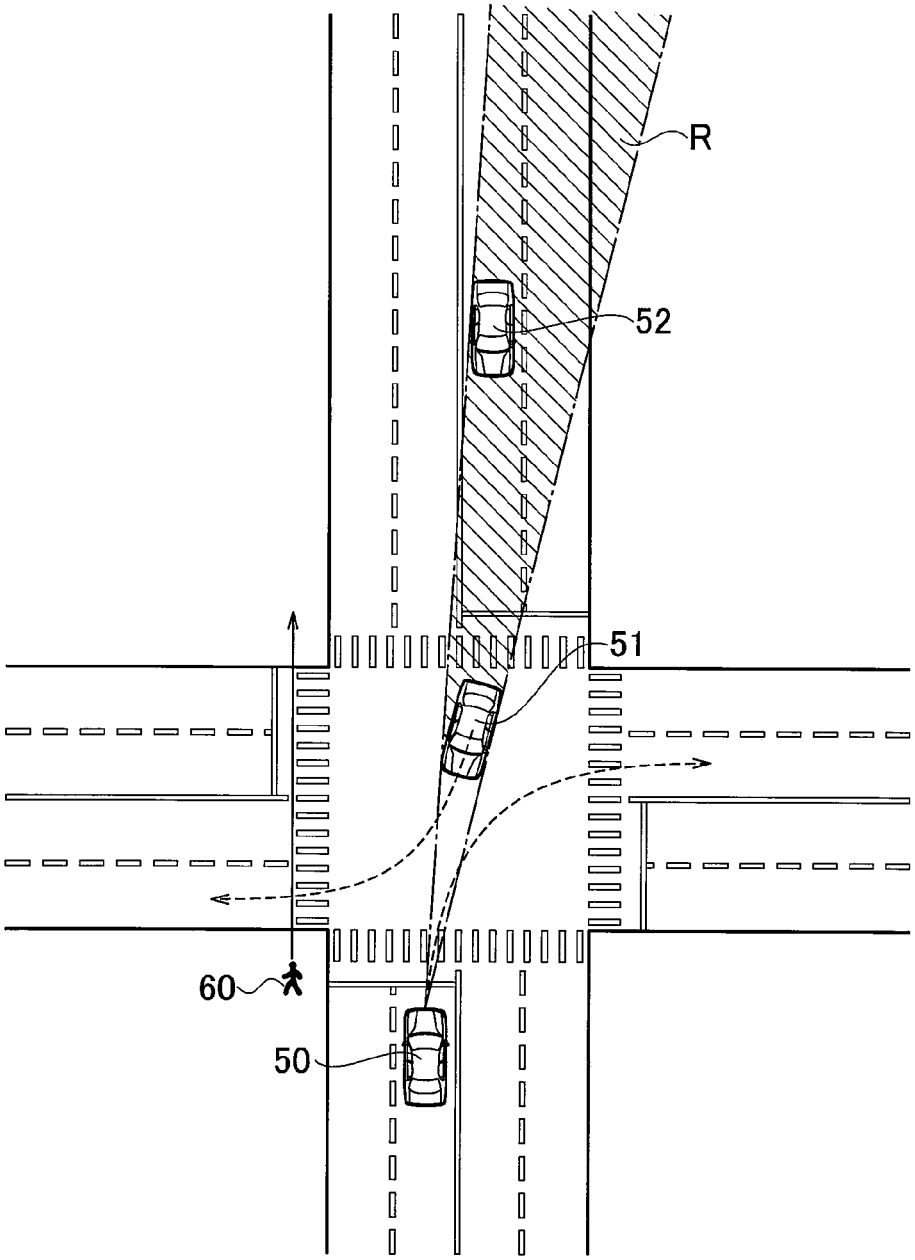
FIG. 3 is a diagram for explaining one example (the intersection) of the course prediction method for a moving object.

FIG. 3 illustrates a traveling situation after the detection-available period T1 has passed since the traveling situation illustrated in FIG. 2. The blind spot region R changes every moment depending on the position, the speed, and the like of each of the host vehicle 50 and the other vehicle 51. On the assumption that the other vehicle 52 keeps traveling straight after being detected, the entry timing presumption unit 14 presumes the detection-available period T1 from the point when the other vehicle 52 is detected to the point when the other vehicle 52 enters the blind spot region R, in accordance with, for example, the speeds and the positional relation between the host vehicle 50, the other vehicle 51, and the other vehicle 52. The case in which the other vehicle 52 cannot be detected after the detection-available period T1 has passed leads to the presumption with high probability that the other vehicle 52 keeps traveling straight. When the other vehicle 52 cannot be detected after the detection-available period T1 has passed, in other words, when the actual detection-available period is longer than or equal to the presumed detection-available period T1, the course prediction unit 17 predicts that the other vehicle 52 keeps traveling straight.

Figure 4:
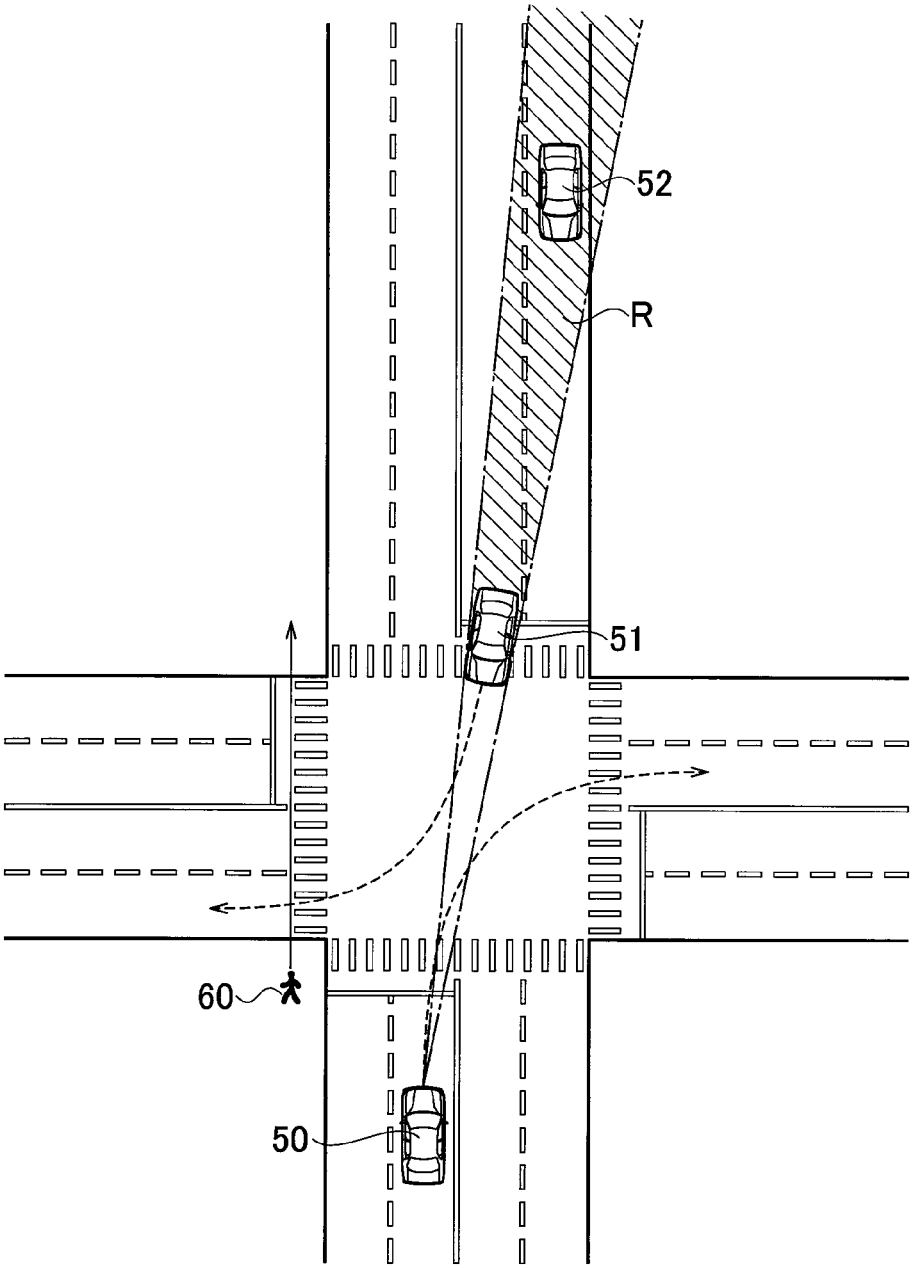
FIG. 4 is a diagram for explaining one example (the intersection) of the course prediction method for a moving object.
Figure 5:
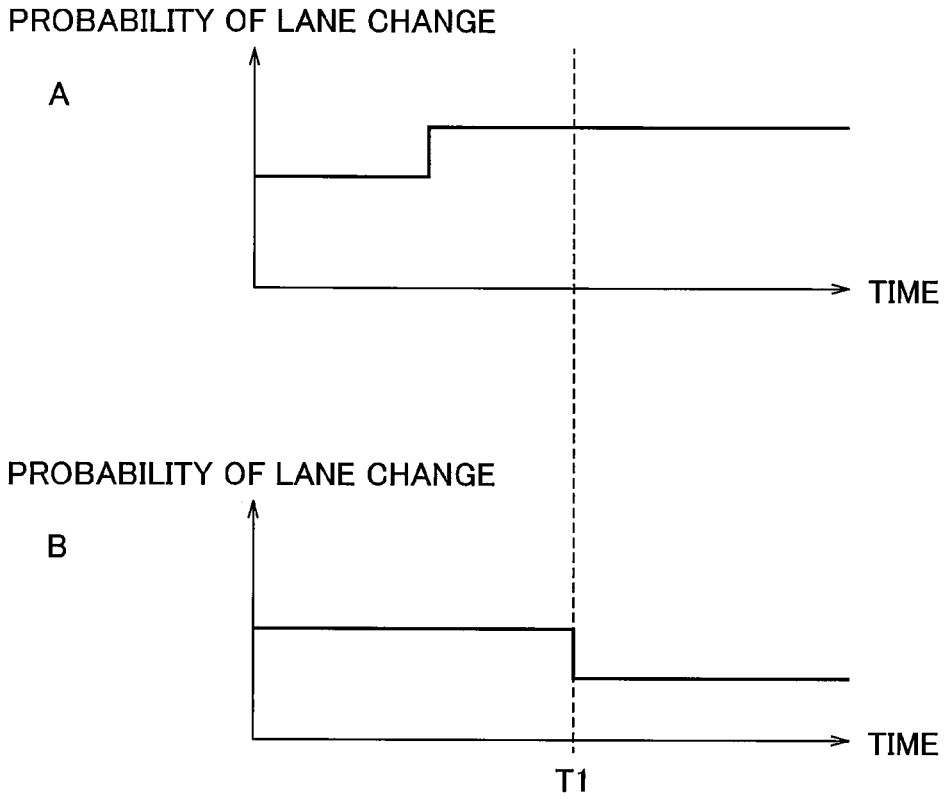
FIG. 5 is a diagram for explaining an increase or a decrease in probability of lane change.

FIG. 4 illustrates a traveling situation before the detection-available period T1 has passed since the traveling situation illustrated in FIG. 2. The case in which the other vehicle 52 enters the blind spot region R before the detection-available period T1 has passed leads to the presumption with high probability that the other vehicle 52 changes the lanes. The reason for this is that the object detection device 1 can detect the other vehicle 52 until the detection-available period T1 has passed if the other vehicle 52 keeps traveling straight in the traveling situation illustrated in FIG. 2. The state in which the object detection device 1 cannot detect the other vehicle 52, namely, the other vehicle 52 enters the blind spot region R before the detection-available period T1 has passed, leads to the presumption with high probability that the other vehicle 52 changes the lanes. The course prediction unit 17 thus predicts that the other vehicle 52 has made a lane change when the other vehicle 52 enters the blind spot region R before the detection-available period T1 has passed, in other words, when the actual detection-available period is shorter than the presumed detection-available period T1. The determination of whether the other vehicle 52 enters the blind spot region R before the detection-available period T1 has passed, is made by the entry determination unit 15.

The present embodiment is illustrated above with the case in which the course prediction unit 17 predicts the course of the other vehicle 52, but is not limited to this case. For example, as shown in graph A of FIG. 5, when the other vehicle 52 enters the blind spot region R before the detection-available period T1 has passed, the course prediction unit 17 may determine that the probability that the other vehicle 52 changes the lanes is high. As shown in graph B of FIG. 5, when the other vehicle 52 cannot be detected after the detection-available period T1 has passed, the course prediction unit 17 may determine that the probability that the other vehicle 52 changes the lanes is low. The state in which the probability that the other vehicle 52 changes the lanes is low corresponds to the state in which the probability that the other vehicle 52 keeps traveling straight is high.

The other vehicle 51 may be any type of vehicle, such as a standard-sized vehicle, a truck, and a bus. The other vehicle 52 is illustrated above as an automobile but is not limited to the automobile. The other vehicle 52 may be any moving object that can travel behind the other vehicle 51, such as a motorcycle or a bicycle.

In the example described above, the entry determination unit 15 compares the detection-available period T1 presumed on the assumption that the other vehicle 52 keeps traveling straight with the actual detection-available period. The course prediction unit 17 then predicts that the other vehicle 52 keeps traveling straight when the actual detection-available period is longer than or equal to the presumed detection-available period T1, and predicts that the other vehicle 52 changes the lanes when the actual detection-available period is shorter than the presumed detection-available period T1. The present embodiment is, however, not limited to this example. The detection-available period T1 may be a detection-available period in a case in which the other vehicle 52 is traveling in a predetermined course. In such a case, the entry determination unit 15 compares the detection-available period T1 with the actual detection-available period so that the course prediction unit 17 can predict whether the other vehicle 52 is traveling in the predetermined course. For example, when the detection-available period T1 is a period on the assumption that the other vehicle 52 makes a lane change, instead of the straight forward movement, the course prediction unit 17 may predict that the other vehicle 52 is traveling straight when the actual detection-available period is longer than the presumed detection-available period T1, and may predict that the other vehicle 52 changes the lanes when the actual detection-available period is shorter than or equal to the presumed detection-available period T1. The detection-available period T1 is preferably the period on the assumption that the other vehicle 52 travels straight as described above, in order to presume the detection-available period T1 accurately.

Figure 6:
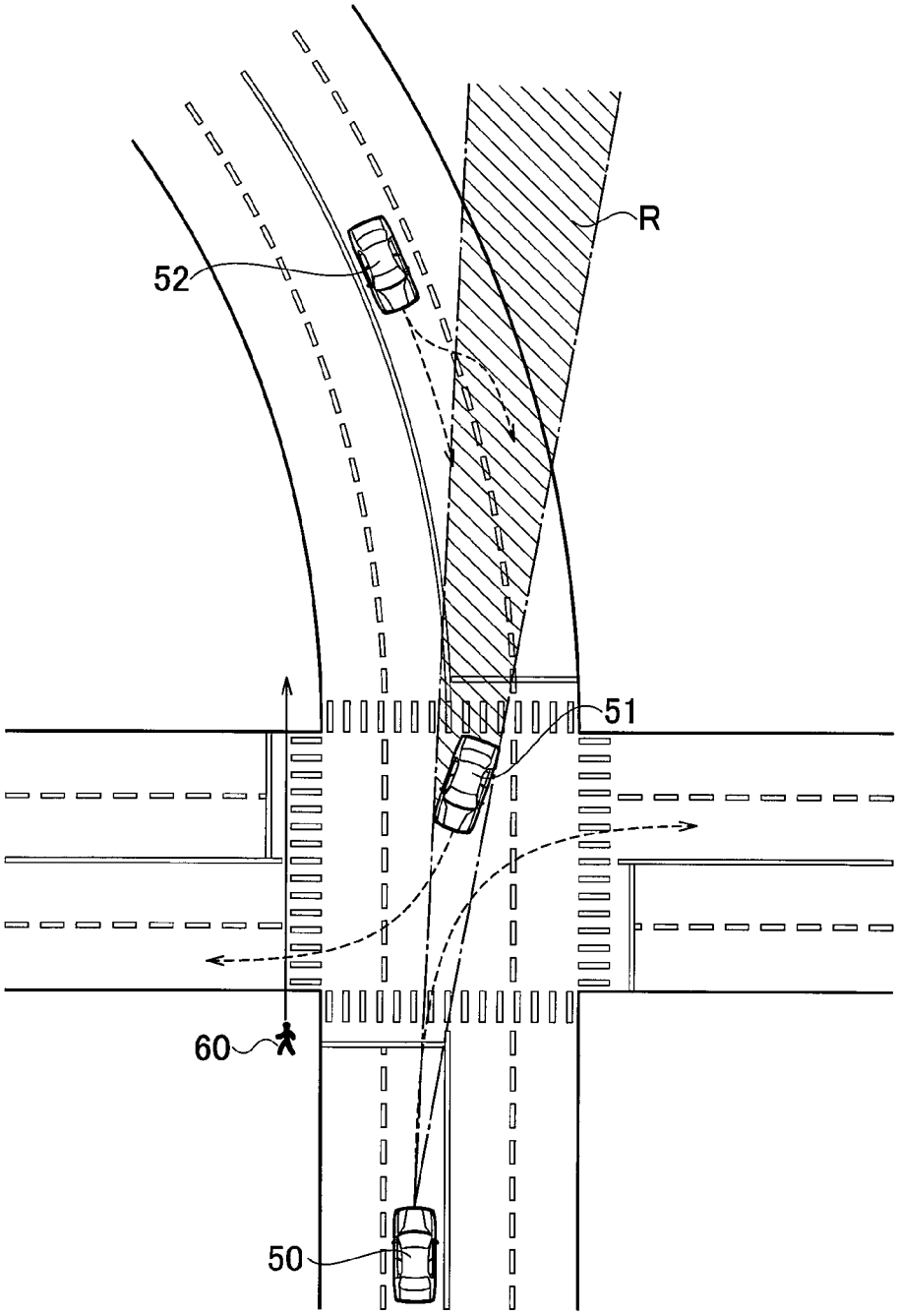
FIG. 6 is a diagram for explaining one example (a curve) of the course prediction method for a moving object.
Figure 7:
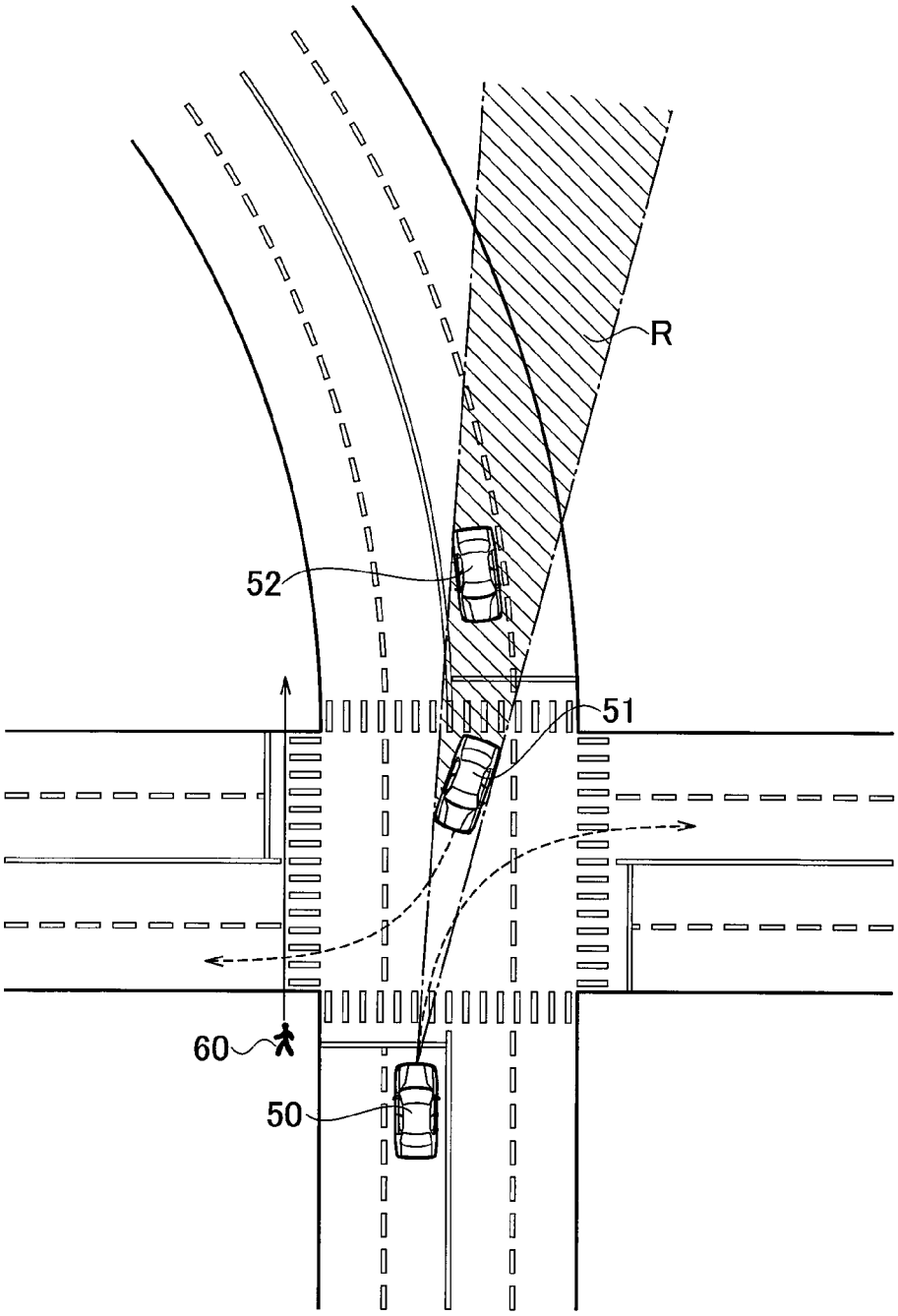
FIG. 7 is a diagram for explaining one example (the curve) of the course prediction method for a moving object.
Figure 8:
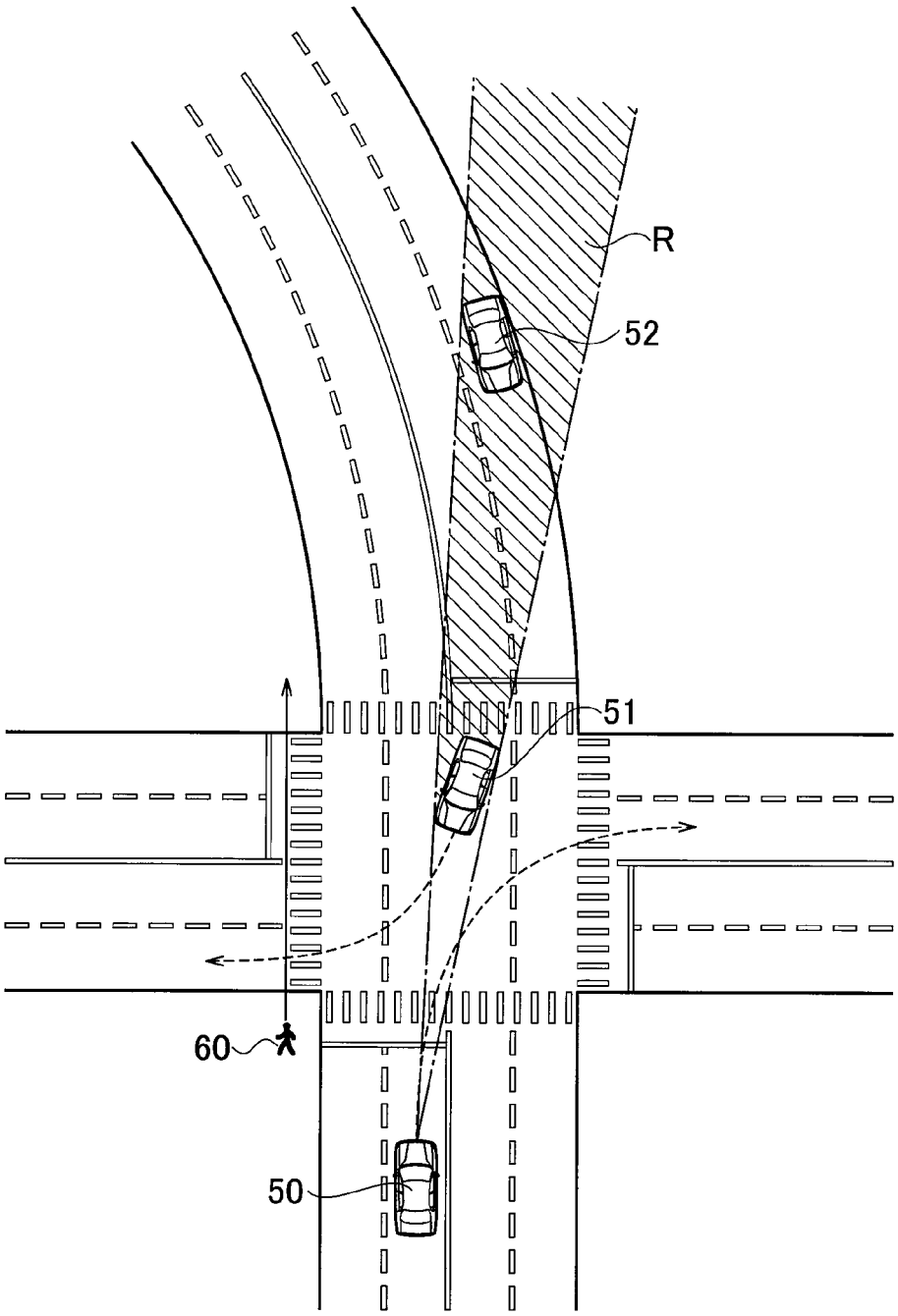
FIG. 8 is a diagram for explaining one example (the curve) of the course prediction method for a moving object.

While FIG. 2 to FIG. 4 illustrate the situations on the straight road, the case to which the present invention is applied is not limited to the straight road. The present invention is applicable to a case of a curved road (FIG. 6 to FIG. 8). There are also two possible courses on the curved road predicted for the other vehicle 52 to travel as indicated by the arrows extending from the other vehicle 52, as illustrated in FIG. 6. As illustrated in FIG. 7, when the other vehicle 52 cannot be detected after the detection-available period T1 has passed, the course prediction unit 17 predicts that the other vehicle 52 travels straight. As illustrated in FIG. 8, when the other vehicle 52 enters the blind spot region R before the detection-available period T1 has passed, the course prediction unit 17 predicts that the other vehicle 52 travels straight. The reason the other vehicle 51 is stopping as illustrated in FIG. 6 to FIG. 8 is that the other vehicle 51 is waiting for a pedestrian 60 to pass across the intersection.

Another example of the course prediction method is described below with reference to FIG. 9 to FIG. 11.

Figure 9:
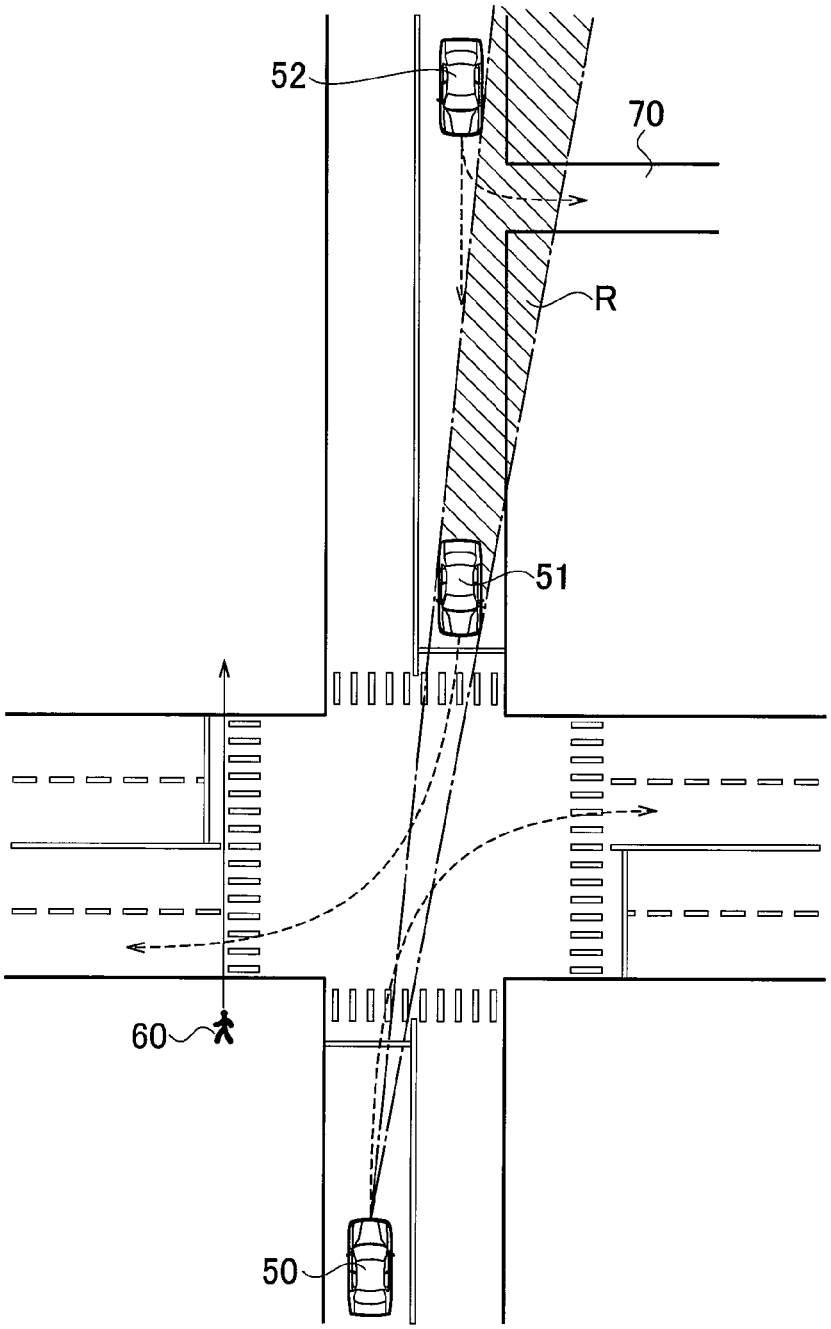
FIG. 9 is a diagram for explaining one example (an access road) of the course prediction method for a moving object.

As illustrated in FIG. 9, the host vehicle 50 is traveling on a one-lane road, and is to turn right at the next intersection. The other vehicle 51 is also traveling on the one-lane road, and is to turn right at the next intersection. The other vehicle 52 is traveling behind the other vehicle 51. In the traveling situation illustrated in FIG. 9, the object detection device 1 can detect the other vehicle 52 which has not entered the blind spot region R yet. There is an available access road 70 on the front left side of the other vehicle 52. There are two possible courses on the road predicted for the other vehicle 52 to travel, as indicated by the arrows extending from the other vehicle 52. One of the courses is that the other vehicle 52 keeps traveling straight to follow the other vehicle 51. The other course is that the other vehicle 52 turns left to enter the access road 70.

Figure 10:
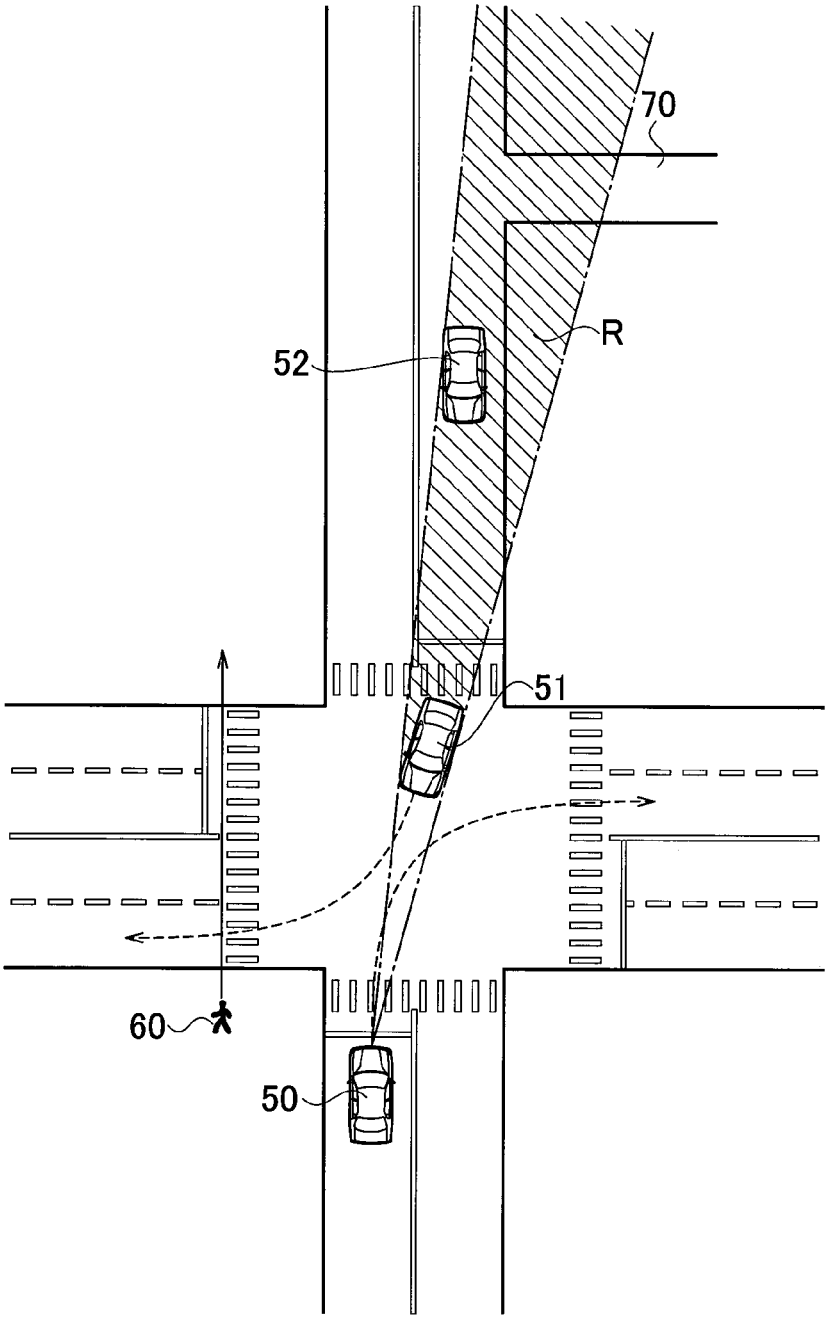
FIG. 10 is a diagram for explaining one example (the access road) of the course prediction method for a moving object.

FIG. 10 illustrates a traveling situation after the detection-available period T1 has passed since the traveling situation illustrated in FIG. 9. As illustrated in FIG. 10, when the other vehicle 52 cannot be detected after the detection-available period T1 has passed, the course prediction unit 17 predicts that the other vehicle 52 keeps traveling straight.

Figure 11:
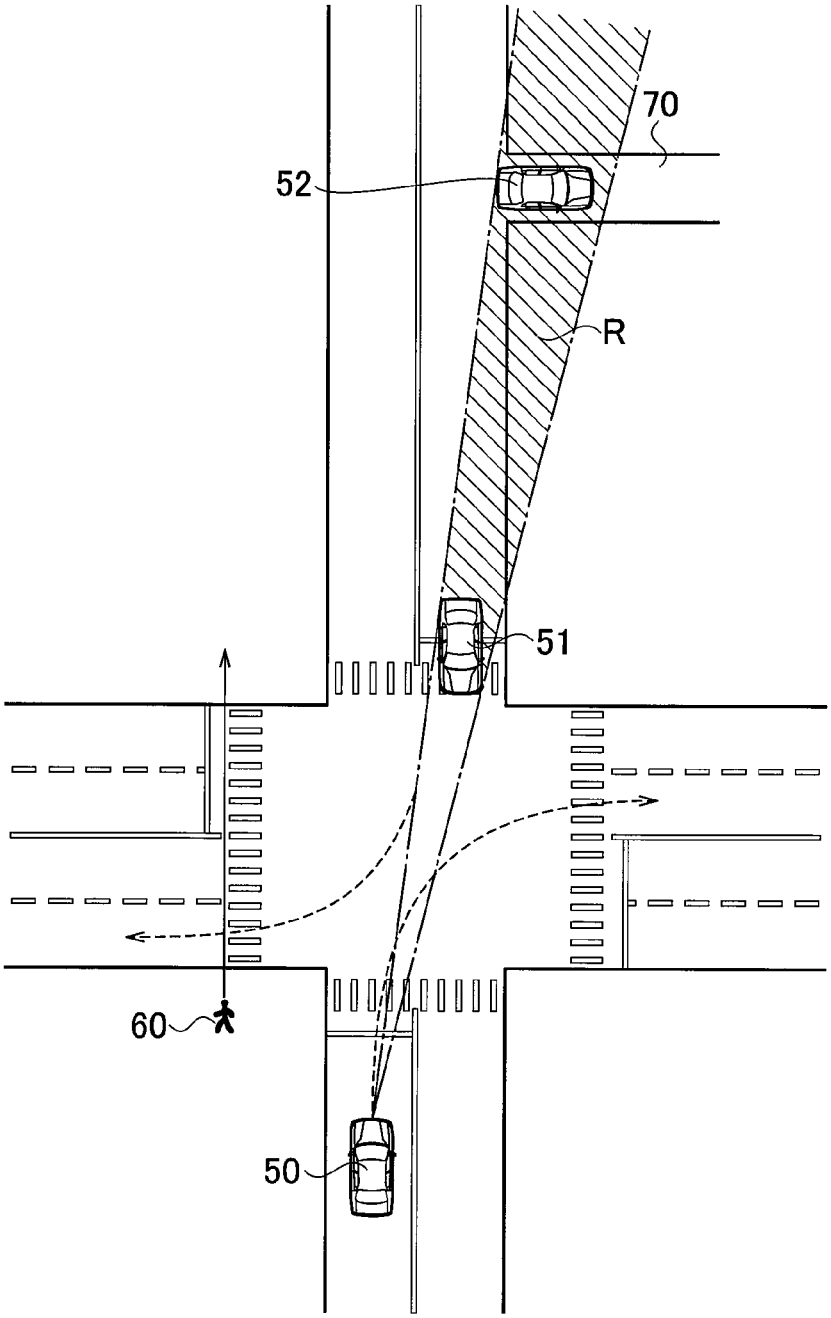
FIG. 11 is a diagram for explaining one example (an access road) of the course prediction method for a moving object.

FIG. 11 illustrates a traveling situation before the detection-available period T1 has passed since the traveling situation illustrated in FIG. 9. The case in which the other vehicle 52 enters the blind spot region R before the detection-available period T1 has passed, leads to the presumption with high probability that the other vehicle 52 makes a left turn. The course prediction unit 17 thus predicts that the other vehicle 52 is turning left when the other vehicle 52 enters the blind spot region R before the detection-available period T1 has passed.

While FIG. 9 to FIG. 11 illustrate the access road 70 as the location at which the other vehicle 52 can turn left, the location at which the other vehicle 52 can turn left is not limited to the access road 70. Examples of locations at which the other vehicle 52 can turn left include a parking space, a gasoline station, and a convenience store.

Still another example of the course prediction method is described below with reference to FIG. 12 to FIG. 14.

Figure 12:
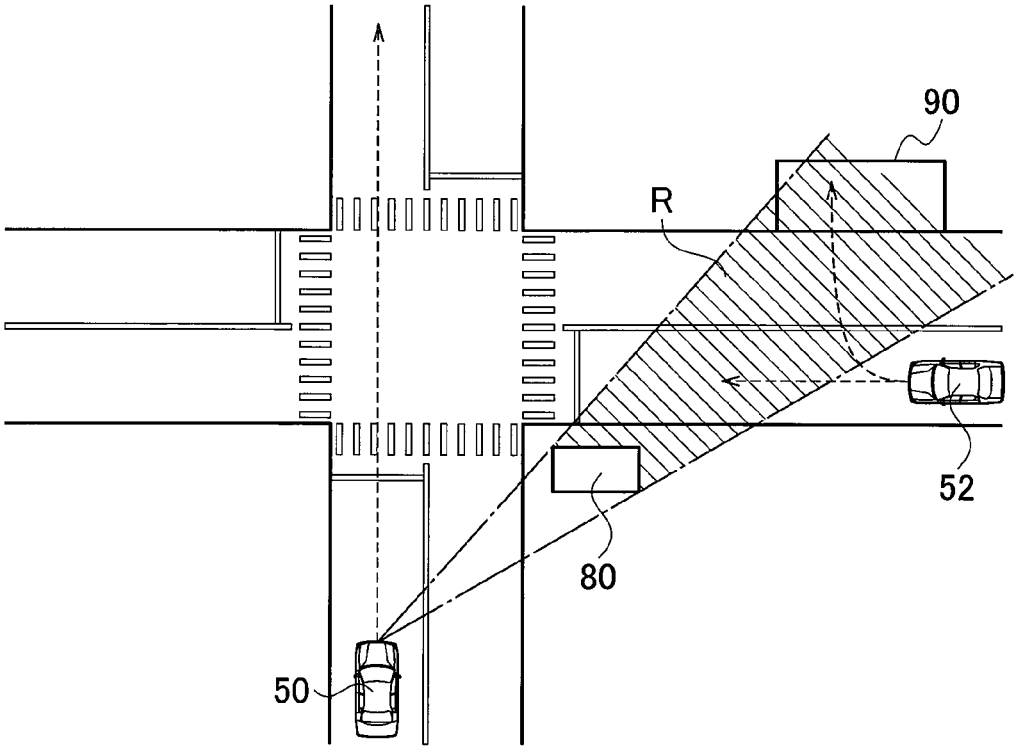
FIG. 12 is a diagram for explaining one example (a parking place) of the course prediction method for a moving object.

As illustrated in FIG. 12, the host vehicle 50 is traveling on a one-lane road, and is to keep traveling straight at the next intersection. The other vehicle 52 is traveling on a one-lane road. Reference sign R shown in FIG. 12 indicates a blind spot region from the host vehicle 50 caused by a building 80. The other vehicle 52 and the building 80 are located on the lateral side (on the front lateral side) of the host vehicle 50, and are detected by the object detection device 1.

In the traveling situation illustrated in FIG. 12, the object detection device 1 can detect the other vehicle 52 which has not entered the blind spot region R yet. There is an available parking place 90 on the front right side of the other vehicle 52. There are two possible courses on the road predicted for the other vehicle 52 to travel, as indicated by the arrows extending from the other vehicle 52. One of the courses is that the other vehicle 52 keeps traveling straight. The other course is that the other vehicle 52 turns right to enter the parking place 90.

Figure 13:
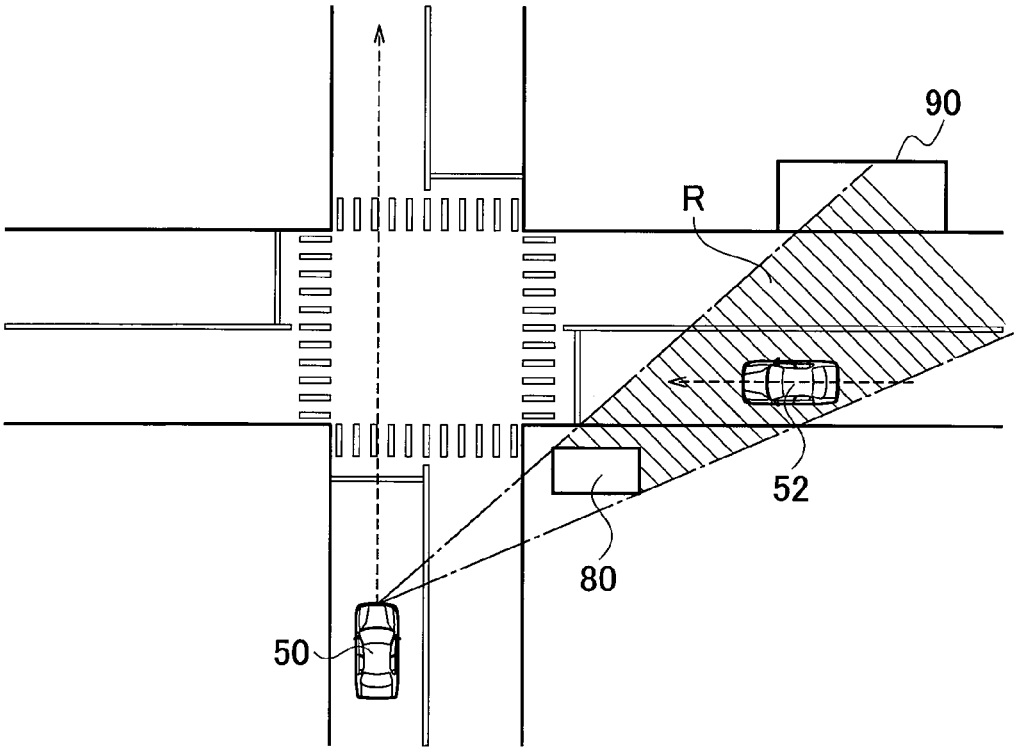
FIG. 13 is a diagram for explaining one example (the parking place) of the course prediction method for a moving object.

FIG. 13 illustrates a traveling situation after the detection-available period T1 has passed since the traveling situation illustrated in FIG. 12. As illustrated in FIG. 13, when the other vehicle 52 cannot be detected after the detection-available period T1 has passed, the course prediction unit 17 predicts that the other vehicle 52 keeps traveling straight.

Figure 14:
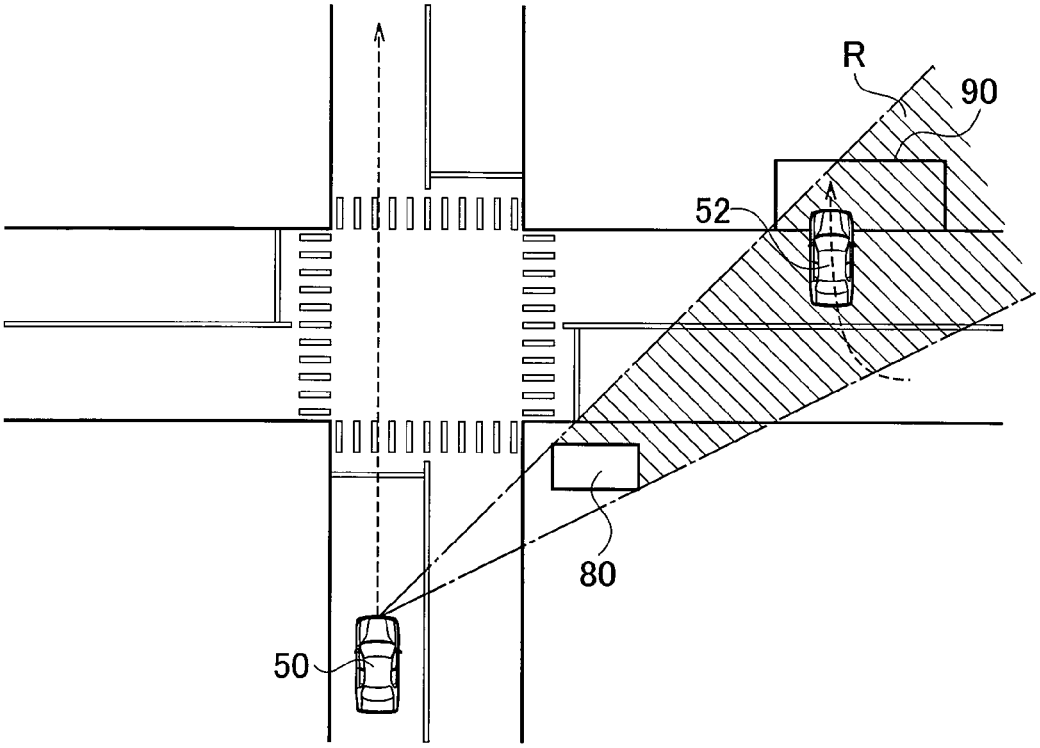
FIG. 14 is a diagram for explaining one example (the parking place) of the course prediction method for a moving object.

FIG. 14 illustrates a traveling situation before the detection-available period T1 has passed since the traveling situation illustrated in FIG. 12. The case in which the other vehicle 52 enters the blind spot region R before the detection-available period T1 has passed leads to the presumption with high probability that the other vehicle 52 makes a right turn. The course prediction unit 17 thus predicts that the other vehicle 52 is turning right when the other vehicle 52 enters the blind spot region R before the detection-available period T1 has passed.

Figure 15A:
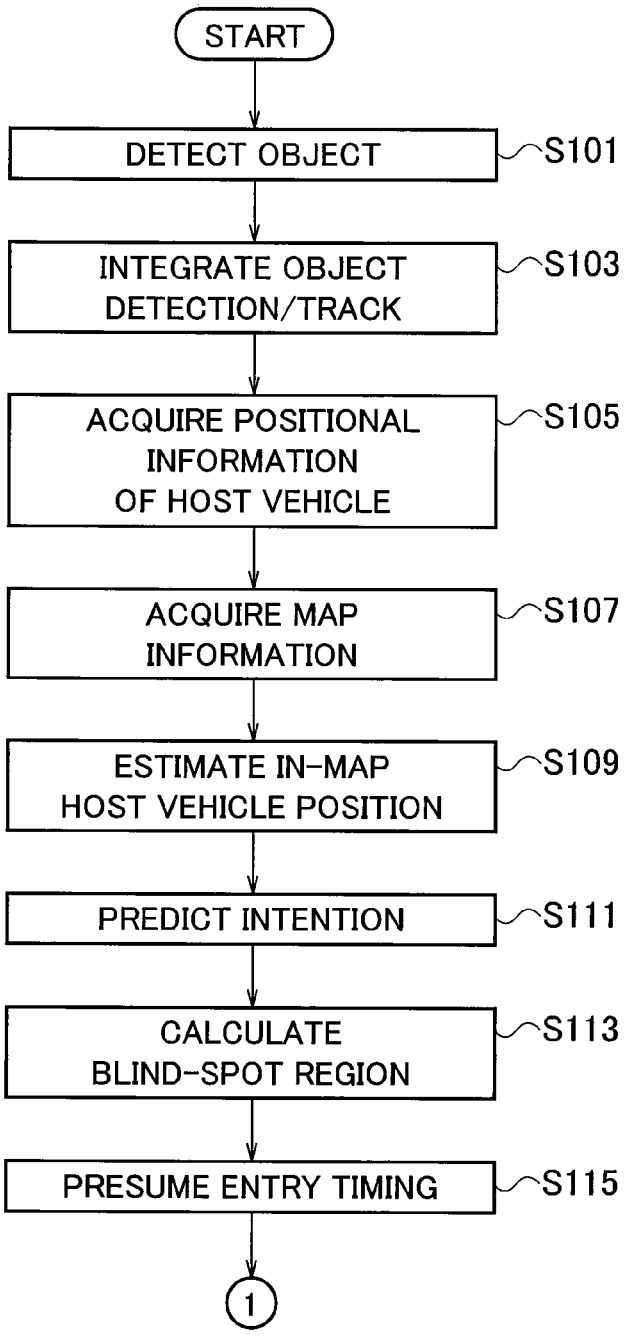
FIG. 15A is a flowchart for explaining an example of operation of the vehicle behavior prediction device according to the embodiment of the present invention.
Figure 15B:
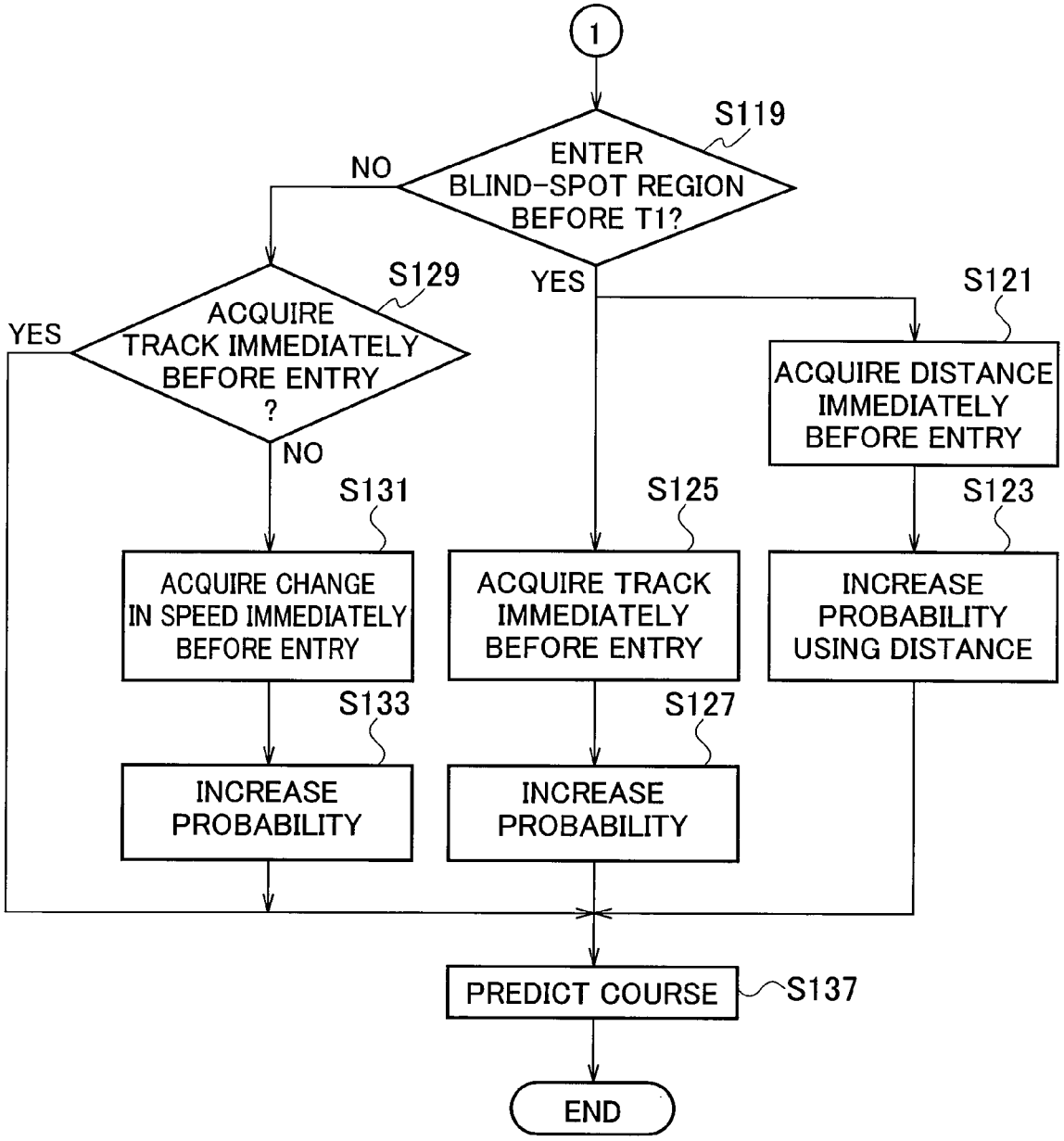
FIG. 15B is a flowchart for explaining an example of operation of the vehicle behavior prediction device according to the embodiment of the present invention.

Next, an example of operation of the vehicle behavior prediction device is described below with reference to the flowcharts shown in FIG. 15A and FIG. 15B.

In step S101, the object detection device 1 detects an object (the other vehicle 51) ahead of the host vehicle 50 by use of the plural object detection sensors. The object detection device 1 also detects a moving object (the other vehicle 52) traveling further than the other vehicle 51 from the host vehicle 50. The process proceeds to step S103, and the detection integration unit 4 integrates the plural detection results obtained by the respective object detection sensors, and outputs a single detection result for the respective other vehicles. The object tracking unit 5 tracks each vehicle detected and integrated.

The process proceeds to step S105, and the host-vehicle position estimation device 2 measures the absolute position of the host vehicle 50 by use of the position detection sensor. The process proceeds to step S107, and the map acquisition device 3 acquires the map information indicating the structure of the road on which the host vehicle 50 is traveling. The process proceeds to step S109, and the in-map position calculation unit 6 estimates the position of the host vehicle 50 on the map in accordance with the absolute position of the host vehicle 50 measured in step S105 and the map data acquired in step S107.

The process proceeds to step S111, and the intention prediction unit 12 predicts the behavior (the course) of each of the other vehicle 51 and the other vehicle 52. FIG. 2 illustrates the case in which the intention prediction unit 12 predicts that the other vehicle 51 is turning right at the next intersection, in accordance with the position, the direction, the attitude, and the on/off state of the turn signals of the other vehicle 51.

The process proceeds to step S113, and the blind spot region calculation unit 13 calculates the blind spot region R from the host vehicle 50 caused by the other vehicle 51, in accordance with the position of the other vehicle 51 detected by the object detection device 1. The process proceeds to step S115, and the entry timing presumption unit 14 presumes the detection-available period T1 from the point when the other vehicle 52 is detected to the point when the other vehicle 52 enters the blind spot region R, in the case in which the other vehicle 52 is traveling straight after being detected.

The process proceeds to step S119, and the entry determination unit 15 determines whether the other vehicle 52 enters the blind spot region R before the detection-available period T1 has passed. The process proceeds to step S121 and step S125 when the other vehicle 52 enters the blind spot region R before the detection-available period T1 has passed (Yes in step S119).

In step S121, the object detection device 1 acquires a distance between the other vehicle 52 and the host vehicle 50 immediately before the other vehicle 52 enters the blind spot region R. The process proceeds to step S123, and the course prediction unit 17 changes the probability of the behavior of the other vehicle 52 in accordance with the distance acquired in step S121. The change in the behavior of the moving object according to the present embodiment refers to one of changing lanes, making a left turn, and a making a right turn. For example, in the example illustrated in FIG. 4, the course prediction unit 17 increases the probability that the other vehicle 52 is making a lane change as the distance between the other vehicle 52 and the host vehicle 50 (not illustrated) is shorter. The reason for this is the errors of the sensors are smaller as the distance of a target from the host vehicle 50 is shorter.

In step S125, the track acquisition unit 16 acquires the track of the other vehicle 52 (the position of the other vehicle 52 in the lane) during the period from the point when the other vehicle 52 is detected to the point immediately before the other vehicle 52 enters the blind spot region R. The process proceeds to step S127, and the course prediction unit 17 increases the probability that the other vehicle 52 changes the behavior in accordance with the track acquired in step S125. For example, in the example illustrated in FIG. 4, the course prediction unit 17 increases the probability that the other vehicle 52 is making a lane change when the track of the other vehicle 52 during the period from the point when the other vehicle 52 is detected to the point immediately before the other vehicle 52 enters the blind spot region R, is different from the track indicating the straight forward movement. In the example illustrated in FIG. 11, the course prediction unit 17 increases the probability that the other vehicle 52 is making a left turn when the track of the other vehicle 52 during the period from the point when the other vehicle 52 is detected to the point when the other vehicle 52 enters the access road 70, is different from the track indicating the straight forward movement. The course prediction unit 17 may predict the course of the other vehicle 52 without executing the process in steps S121, S123, S125, and S127. Namely, the course prediction unit 17 may predict that the other vehicle 52 is making a lane change, making a left turn, or making a right turn, only in accordance with the state in which the other vehicle 52 enters the blind spot region R before the detection-available period T1 has passed. In the example illustrated in FIG. 11, the course prediction unit 17 may increase the probability of the left turn of the other vehicle 52 to predict that the other vehicle has turned left when the track of the other vehicle 52 during the period from the point when the other vehicle 52 is detected to the point immediately before the other vehicle 52 enters the blind spot region R, indicates the track of traveling on the left side (on the shoulder edge side) in the traveling lane.

When the other vehicle 52 enters the blind spot region R after the detection-available period T1 has passed (No in step S119), the process proceeds to step S129. In step S129, the course prediction unit 17 acquires the track of the other vehicle 52 during the period from the point when the other vehicle 52 is detected to the point immediately before the other vehicle 52 enters the blind spot region R. When the track of the other vehicle 52 indicates the straight forward movement, the course prediction unit 17 increases the probability of the straight forward movement of the other vehicle 52 to predict that the other vehicle 52 keeps traveling straight (in step S137). When the track of the other vehicle 52 is not acquired (No in step S129), the process proceeds to step S131, and the course prediction unit 17 acquires a change in speed of the other vehicle 52 immediately before the other vehicle 52 enters the blind spot region R. The process proceeds to step S133, and the course prediction unit 17 increases the probability that the other vehicle 52 is traveling straight in accordance with the change in speed acquired in step S131. The course prediction unit 17 may predict the course of the other vehicle 52 without executing the process in steps S129, S131, and S133. Namely, the course prediction unit 17 may predict that the other vehicle 52 keeps traveling straight only in accordance with the state in which the other vehicle 52 enters the blind spot region R after the detection-available period T1 has passed.

Figure 16:
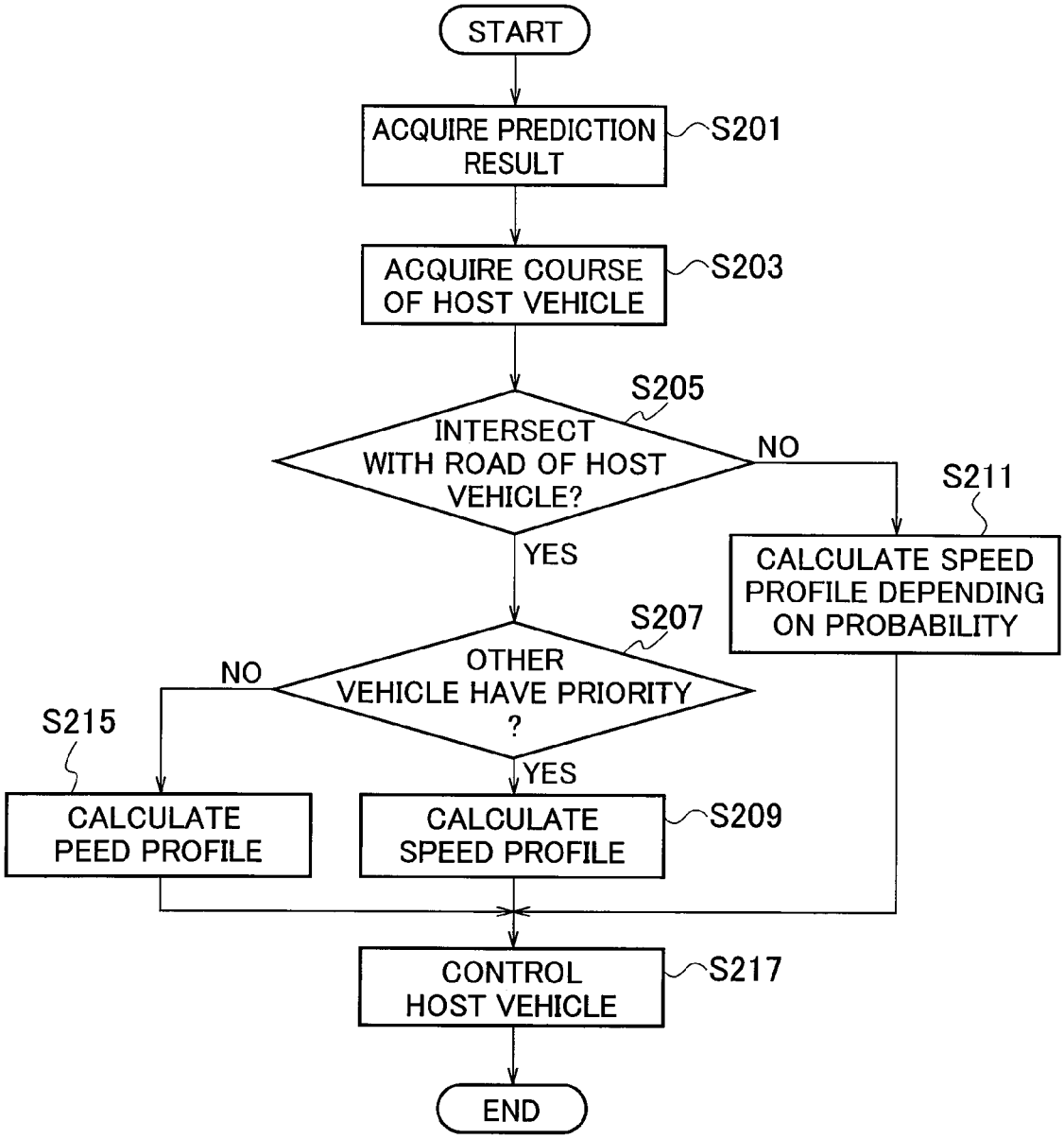
FIG. 16 is a flowchart for explaining an example of operation of the vehicle behavior prediction device according to the embodiment of the present invention.

The vehicle behavior prediction device may control the host vehicle in accordance with the predicted course of the other vehicle 52. The specific explanations are made below with reference to FIG. 16.

In step S201, the vehicle control unit 30 acquires the course of the other vehicle 52 predicted by the course prediction unit 17. The process proceeds to step S203, and the vehicle control unit 30 acquires a course of the host vehicle 50 preliminarily set.

The process proceeds to step S205, and the vehicle control unit 30 determines whether the course of the other vehicle 52 intersects with the course of the host vehicle 50. When the course of the other vehicle 52 and the course of the host vehicle 50 intersect with each other (Yes in step S205), the process proceeds to step S207, and the vehicle control unit 30 then determines whether the road on which the other vehicle 52 is traveling has priority. The determination on the priority between the roads is made in accordance with a road structure, road signs, and traffic regulations. When the road on which the other vehicle 52 is traveling has priority (Yes in step S207), the process proceeds to step S209, and the vehicle control unit 30 calculates a speed profile for decelerating or stopping the host vehicle 50. The speed profile as used herein is to indicate the speed of the host vehicle 50 as a function of time. In the example illustrated in FIG. 4, the course of the other vehicle 52 intersects with the course of the host vehicle 50, and the road on which the other vehicle 52 is traveling has priority. In this case, the vehicle control unit 30 calculates the speed profile for decelerating or stopping the host vehicle 50 so as to wait for the other vehicle 52 to pass through. The process proceeds to step S217, and the vehicle control unit 30 controls the brake actuator and the like in accordance with the speed profile so as to execute the autonomous driving control. This can prevent sudden deceleration.

When the course of the other vehicle 52 does not intersect with the course of the host vehicle 50 (No in step S205), the process proceeds to step S211, and the vehicle control unit 30 calculates the speed profile depending on the degree of the probability of the course of the other vehicle 52. As illustrated in FIG. 3, when the probability that the other vehicle 52 keeps traveling straight is high, the vehicle control unit 30 calculates the speed profile indicating a constant speed. The process proceeds to step S217, and the vehicle control unit 30 executes the autonomous driving control based on the speed profile. This enables the smooth autonomous driving accordingly.

When the road on which the other vehicle 52 is traveling does not have priority (No in step S207), namely when the road on which the host vehicle 50 is traveling has priority, the process proceeds to step S215. In step S215, the vehicle control unit 30 calculates the speed profile indicating a constant speed. The process proceeds to step S217, and the vehicle control unit 30 executes the autonomous driving control based on the speed profile. This enables the smooth autonomous driving accordingly.

As described above, the vehicle behavior prediction device according to the present embodiment can achieve the following functional effects.

The object detection device 1 detects an object (the other vehicle 51 or the building 80) on the front side or the lateral side of the host vehicle 50. The object detection device 1 also detects the position of the object with respect to the host vehicle 50 on the front side or the lateral side of the host vehicle 50. The object detection device 1 further detects a moving object (the other vehicle 52) traveling further than the object from the host vehicle 50. The blind spot region calculation unit 13 calculates the blind spot region R from the host vehicle 50 caused by the object, in accordance with the position of the object detected by the object detection device 1. The entry timing presumption unit 14 presumes the detection-available period T1 from the point when the moving object is detected to the point when the moving object enters the blind spot region R, in the case in which the moving object is traveling straight after being detected. The entry determination unit 15 determines whether the moving object enters the blind spot region R before the detection-available period T1 has passed. The vehicle control unit 30 predicts the course of the moving object in accordance with the determination result. In the example illustrated in FIG. 4, the course prediction unit 17 predicts that the other vehicle 52 (the moving object) has changed the lanes when the other vehicle 52 enters the blind spot region R before the detection-available period T1 has passed. The vehicle behavior prediction device according to the present embodiment thus can predict the course of the moving object at an early stage. As described above, the object on the front side or the lateral side of the host vehicle 50 may be either the moving object (the other vehicle 51) or the stationary object (the building 80). The other vehicle 51 is an oncoming vehicle traveling on the same road as the host vehicle 50 in the direction opposite to the direction in which the host vehicle 50 is traveling. The stationary object is not limited to the building 80. Examples of stationary objects include parked vehicles. The detection-available period T1 may be the period from the point when the other vehicle 52 is detected to the period when the other vehicle 52 enters the blind spot region R in the case in which the other vehicle 52 is traveling along a predetermined course after being detected. The predetermined course includes the straight forward movement and the lane change. The object detection device 1 may compare the presumed detection-available period T1 with the actual detection-available period from the point when the other vehicle 52 is detected to the period when the other vehicle 52 actually enters the blind spot region R, so as to predict the course of the other vehicle 52 in accordance with the comparison result.

In the case in which the road on which the moving object is traveling includes a plurality of lanes, and the moving object is traveling in one of the plural lanes other than the lane furthest from the host vehicle 50 when detecting the moving object, and in which the entry determination nit 15 determines that the moving object enters the blind spot region R before the detection-available period T1 has passed, the course prediction unit 17 predicts that the moving object has changed the lanes. In the example illustrated in FIG. 2, the road on which the other vehicle 52 (the moving object) is traveling includes the plural lanes (the two lanes), and the other vehicle 52 is traveling in the lane of the plural lanes, other than the lane furthest from the host vehicle 50 when detecting the other vehicle 52. In FIG. 2, the lane furthest from the host vehicle 50 on the lane on which the other vehicle 52 is traveling is the left lane. As illustrated in FIG. 2, the other vehicle 52 is traveling in the right lane. As illustrated in FIG. 4, when the other vehicle 52 enters the blind spot region R before the detection-available period T1 has passed, the course prediction unit 17 predicts that the other vehicle 52 has changed the lanes. The vehicle behavior prediction device according to the present embodiment thus can predict the course of the moving object at an early stage.

In the case in which there is an entry-available place on the left side along the road on which the moving object is traveling, and in which the entry determination unit 15 determines that the moving object enters the blind spot region R before the detection-available period T1 has passed, the course prediction unit 17 predicts that the moving object has made a left turn. In the example illustrated in FIG. 9, the entry-available place (the access road 70) is present on the left side along the road on which the other vehicle 52 (moving object) is traveling. As illustrated in FIG. 11, when the other vehicle 52 enters the blind spot region R before the detection-available period T1 has passed, the course prediction unit 17 predicts that the other vehicle 52 has made a left turn. The vehicle behavior prediction device according to the present embodiment thus can predict the course of the moving object at an early stage.

In the case in which there is an entry-available place on the right side along the road on which the moving object is traveling, and in which the entry determination unit 15 determines that the moving object enters the blind spot region R before the detection-available period T1 has passed, the course prediction unit 17 predicts that the moving object has made a right turn. In the example illustrated in FIG. 12, the entry-available place (the parking place 90) is present on the right side along the road on which the other vehicle 52 (moving object) is traveling. As illustrated in FIG. 14, when the other vehicle 52 enters the blind spot region R before the detection-available period T1 has passed, the course prediction unit 17 predicts that the other vehicle 52 has made a right turn. The vehicle behavior prediction device according to the present embodiment thus can predict the course of the moving object at an early stage.

When the entry determination unit 15 determines that the moving object enters the blind spot region R before the detection-available period T1 has passed, the course prediction unit 17 increases the probability of change in the behavior of the moving object, as the distance between the moving object and the host vehicle 50 is shorter. According to the present embodiment, the change in the behavior of the moving object refers to one of changing lanes, making a left turn, and a making a right turn. The course prediction unit 17 increases the probability that the moving object has changed the lanes, has made a left turn, or has made a right turn, as the distance between the moving object and the host vehicle 50 is shorter. Since the errors of the sensors are smaller as the distance of a target from the host vehicle 50 is shorter, the course prediction unit 17 increases the probability as described above, so as to predict the course of the moving object with a high accuracy.

When the entry determination unit 15 determines that the moving object enters the blind spot region R before the detection-available period T1 has passed, the course prediction unit 17 increases the probability of change in the behavior of the moving object in accordance with the track of the moving object from the point when the moving object is detected to the point immediately before the moving object enters the blind spot region R. In the example illustrated in FIG. 4, when the track of the other vehicle 52 (the moving object) during the period from the point when the other vehicle 52 is detected to the point immediately before the other vehicle 52 enters the blind spot region R, is different from the track indicating the straight forward movement, the course prediction unit 17 increases the probability that the other vehicle 52 has changed the lanes. The course prediction unit 17 thus increases the probability of change in the behavior in accordance with the track of the moving object, so as to predict the course of the moving object with a high accuracy.

When the entry determination unit 15 determines that the moving object enters the blind spot region R after the detection-available period T1 has passed, the course prediction unit 17 predicts that the moving object keeps traveling straight. The host vehicle 50 thus can pass through the intersection without waiting for the other vehicle 52 (the moving object), as illustrated in FIG. 3. This contributes to smooth traveling of the host vehicle 50 accordingly.

When the entry determination unit 15 determines that the moving object enters the blind spot region R after the detection-available period T1 has passed, the course prediction unit 17 may increase the probability that the moving object keeps traveling straight, as the distance between the moving object and the host vehicle 50 is shorter. When the track of the moving object from the point when the moving object is detected to the point immediately before the moving object enters the blind spot region R, indicates the straight forward movement, the course prediction unit 17 may increase the probability that the moving object keeps traveling straight. The course prediction unit 17 increases the probability as described above, so as to predict the course of the moving object with a high accuracy.

The vehicle control unit 30 calculates the speed profile for the host vehicle 50 based on the course of the other vehicle 52 predicted by the course prediction unit 17. The vehicle control unit 30 then controls the host vehicle 50 in accordance with the calculated speed profile. This prevents sudden deceleration and achieves the smooth autonomous driving. For example, as illustrated in FIG. 4, when the course of the other vehicle 52 intersects with the course of the host vehicle 50, and when the road on which the other vehicle 52 is traveling has priority, the vehicle control unit 30 calculates the speed profile for decelerating or stopping the host vehicle 50 so as to wait for the other vehicle 52 to pass through. The vehicle control unit 30 controls the brake actuator and the like in accordance with the speed profile so as to execute the autonomous driving control. This can prevent sudden deceleration.

When the course of the moving object intersects with the course of the host vehicle 50, and when the road on which the host vehicle 50 is traveling has priority, the vehicle control unit 30 may calculate the speed profile indicating a constant speed to execute the autonomous driving control based on the speed profile. When the course of the moving object does not intersect with the course of the host vehicle 50, the vehicle control unit 30 may calculate the speed profile indicating a constant speed to execute the autonomous driving control based on the speed profile. This enables the smooth autonomous driving accordingly.

The respective functions described in the above embodiment can be implemented in single or plural processing circuits. The respective processing circuits include a programmed processing device, such as a processing device including an electric circuit. The respective processing circuits also include an application-specific integrated circuit (ASIC) configured to execute the functions described above, or other devices such as circuit components. The vehicle behavior prediction device can improve the functions of the computer.

While the present invention has been described above by reference to the embodiment, it should be understood that the present invention is not intended to be limited to the descriptions and the drawings composing part of this disclosure. Various alternative embodiments, examples, and technical applications will be apparent to those skilled in the art according to this disclosure.

REFERENCE SIGNS LIST

1 OBJECT DETECTION DEVICE
2 HOST-VEHICLE POSITION ESTIMATION DEVICE
3 MAP ACQUISITION DEVICE
4 DETECTION INTEGRATION UNIT
5 OBJECT TRACKING UNIT
6 IN-MAP POSITION CALCULATION UNIT
10 BEHAVIOR PREDICTION UNIT
11 LANE DETERMINATION UNIT
12 INTENTION PREDICTION UNIT
13 BLIND SPOT REGION CALCULATION UNIT
14 ENTRY TIMING PRESUMPTION UNIT
15 ENTRY DETERMINATION UNIT
16 TRACK ACQUISITION UNIT
17 COURSE PREDICTION UNIT
30 VEHICLE CONTROL UNIT

The invention claimed is:

1. A vehicle behavior prediction method comprising:

detecting a position of an object, with respect to a host vehicle, located on a front side or a lateral side of the host vehicle by use of a sensor mounted on the host vehicle;

detecting a moving object traveling farther than the object from the host vehicle by use of the sensor;

calculating, based on the position, a blind spot region from the host vehicle caused by the object in which the sensor cannot detect;

presuming a detection-available period based on speed and the detected position of the object from a point when the moving object is detected to a point when the moving object enters the blind spot region in a case in which the moving object travels in a predetermined course after being detected;

comparing the presumed detection-available period with an actual detection-available period from the point when the moving object is detected to a point when the moving object actually enters the blind spot region; and predicting that a course of the moving object is a straight forward movement when the actual detection-available period is longer than or equal to the presumed detection-available period.

2. The vehicle behavior prediction method according to claim 1, wherein:

the course of the moving object is predicted in accordance with a result of comparison of whether the actual detection-available period is shorter than the presumed detection-available period.

3. The vehicle behavior prediction method according to claim 1, wherein the object is an oncoming vehicle traveling in an opposite direction of the host vehicle on a road on which the host vehicle is also traveling.

4. The vehicle behavior prediction method according to claim 1, wherein the object is a stationary object.

5. The vehicle behavior prediction method according to claim 1, further comprising:

predicting that the moving object makes a lane change when the actual detection-available period is shorter than the presumed detection-available period, in a case in which the predetermined course is a straight forward movement, the road on which the moving object is traveling includes a plurality of lanes, and the moving object is traveling in one of the plural lanes other than a lane farthest from the host vehicle when detecting the moving object.

6. The vehicle behavior prediction method according to claim 1, further comprising:

predicting that the moving object makes a left turn when the actual detection-available period is shorter than the presumed detection-available period, in a case in which the predetermined course is a straight forward movement, and there is an entry-available place on a left side of the road on which the moving object is traveling.

7. The vehicle behavior prediction method according to claim 1, further comprising:

predicting that the moving object makes a right turn when the actual detection-available period is shorter than the presumed detection-available period, in a case in which the predetermined course is a straight forward movement, and there is an entry-available place on a right side of the road on which the moving object is traveling.

8. The vehicle behavior prediction method according to claim 1, further comprising:

increasing a probability that a behavior of the moving object is changed as a distance between the moving object and the host vehicle is shorter, in a case in which the predetermined course is a straight forward movement, and the actual detection-available period is shorter than the presumed detection-available period; and predicting the course of the moving object in accordance with the probability and the result of the comparison.

9. The vehicle behavior prediction method according to claim 1, further comprising:

increasing a probability that a behavior of the moving object is changed in accordance with a track of the moving object from the point when the moving object is detected to a point immediately before the moving object enters the blind spot region, in a case in which the predetermined course is a straight forward movement, and the actual detection-available period is shorter than the presumed detection-available period; and predicting the course of the moving object in accordance with the probability and the result of the comparison.

10. The vehicle behavior prediction method according to claim 1, further comprising predicting that the moving object travels straight in a case in which the predetermined course is a straight forward movement, and the actual detection-available period is greater than or equal to the presumed detection-available period.

11. The vehicle behavior prediction method according to claim 10, further comprising:

increasing a probability that the moving object travels straight as a distance between the moving object and the host vehicle is shorter, or increasing the probability that the moving object travels straight in accordance with a track of the moving object from the point when the moving object is detected to a point immediately before the moving object enters the blind spot region; and predicting that the moving object travels straight.

12. The vehicle behavior prediction method according to claim 1, further comprising:

calculating a speed profile indicating a speed of the host vehicle as a function of time in accordance with a result of the prediction of the course of the moving object.

13. A vehicle control method of controlling the host vehicle by use of the vehicle behavior prediction method according to claim 12, the vehicle control method comprising:

calculating the speed profile for decelerating or stopping the host vehicle when the course of the moving object intersects with a course of the host vehicle, and a road on which the moving object is traveling has priority; and controlling the host vehicle in accordance with the speed profile.

14. A vehicle control method of controlling the host vehicle by use of the vehicle behavior prediction method according to claim 12, the vehicle control method comprising:

calculating the speed profile indicating a constant speed when the course of the moving object intersects with a course of the host vehicle, and a road on which the host vehicle is traveling has priority; and controlling the host vehicle in accordance with the speed profile.

15. A vehicle control method of controlling the host vehicle by use of the vehicle behavior prediction method according to claim 12, the vehicle control method comprising:

calculating the speed profile indicating a constant speed when the course of the moving object does not intersect with a course of the host vehicle; and controlling the host vehicle in accordance with the speed profile.

16. A vehicle behavior prediction device comprising:

a sensor configured to detect a position of an object, with respect to a host vehicle, located on a front side or a lateral side of the host vehicle, and a moving object traveling farther than the object from the host vehicle; and a control unit, the control unit being configured to:

calculate, based on the position detected by the sensor, a blind spot region from the host vehicle caused by the object in which the sensor cannot detect;

presume a detection-available period based on speed and the detected position of the object from a point when the moving object is detected to a point when the moving object enters the blind spot region in a case in which the moving object travels in a predetermined course after being detected by the sensor;

compare the presumed detection-available period with an actual detection-available period from the point when the moving object is detected to a point when the moving object actually enters the blind spot region; and predict that a course of the moving object is a straight forward movement when the actual detection-available period is longer than or equal to the presumed detection-available period.

17. The vehicle behavior prediction device according to claim 16, wherein:

the control unit predicts the course of the moving object in accordance with a result of comparison of whether the actual detection-available period is shorter than the presumed detection-available period.

* * * * *